US011542440B2

(12) United States Patent
Indurain Y Urricelqui et al.

(10) Patent No.: US 11,542,440 B2
(45) Date of Patent: Jan. 3, 2023

(54) TUBE FOR A STEAM CRACKING FURNACE HAVING A SEGMENT WITH AN ELLIPTICAL OR LOBED CROSS SECTION

(71) Applicants: Centre National de la Recherche Scientifique, Paris (FR); Manoir Pitres, Paris (FR)

(72) Inventors: Bruce Indurain Y Urricelqui, Valenciennes (FR); Sylvain Lalot, Querenaing (FR); Mathieu Couvrat, Pitres (FR); François Beaubert, Marcq en Baroeul (FR); David Uystepruyst, Valenciennes (FR)

(73) Assignees: Centre National de la Recherche Scientifique, Paris (FR); Manoir Pitres, Paris (FR)

( * ) Notice: Subject to any disclaimer, the term of this patent is extended or adjusted under 35 U.S.C. 154(b) by 307 days.

(21) Appl. No.: 16/888,390

(22) Filed: May 29, 2020

(65) Prior Publication Data

US 2020/0377801 A1 Dec. 3, 2020

(30) Foreign Application Priority Data

May 31, 2019 (FR) ..... 1905801

(51) Int. Cl.
*C10G 9/20* (2006.01)
*F28F 1/06* (2006.01)
*F28F 19/00* (2006.01)

(52) U.S. Cl.
CPC ..... *C10G 9/20* (2013.01); *F28F 1/06* (2013.01); *F28F 19/00* (2013.01)

(58) Field of Classification Search
CPC ..... C10G 9/20; F28F 1/06; F28F 19/00; B01J 19/243
(Continued)

(56) References Cited

U.S. PATENT DOCUMENTS 2,246,418 A * 6/1941 Froome ..... E21B 17/22 175/218
3,015,355 A 1/1962 Humphrey
(Continued)

FOREIGN PATENT DOCUMENTS

CN 1408491 A * 4/2003
CN 102735089 A 10/2012
(Continued)

OTHER PUBLICATIONS

European Extended Search Report and Opinion for European Application No. 20176929, dated Oct. 23, 2020, 6 pages.

*Primary Examiner* — Jon T. Schermerhorn, Jr.
(74) *Attorney, Agent, or Firm* — TraskBritt

(57) ABSTRACT

A tube for a steam cracking furnace comprising: at least one downstream tubular segment of circular section having a main diameter; at least one twisted tubular segment having a length less than a quarter of the length of the tube, and comprising: a central part with an elliptical or lobed section, having a helical pitch between one times and ten times the main diameter, and an aspect ratio of the elliptical or lobed section between 0.5 and 0.8; an upstream transition part establishing a geometric transition between the central part and a tubular segment of circular section; a downstream transition part establishing a geometric transition between the central part and the downstream tubular segment, with a fluid being intended to flow from the upstream transition part to the downstream transition part.

20 Claims, 3 Drawing Sheets

(58) Field of Classification Search
USPC ..... 349/172
See application file for complete search history.

(56) References Cited

U.S. PATENT DOCUMENTS

| | | | | |
|---|---|---|---|---|
| 3,779,312 | A * | 12/1973 | Withers, Jr. | F28F 1/426 165/184 |
| 4,171,634 | A * | 10/1979 | Perkins | B21D 11/14 72/299 |
| 6,530,422 | B2 | 3/2003 | Zhu et al. | |
| 7,749,462 | B2 * | 7/2010 | Caro | B01J 6/008 422/204 |
| 8,029,749 | B2 * | 10/2011 | Caro | C10G 9/20 422/198 |
| 8,088,345 | B2 * | 1/2012 | Caro | B01F 25/433 208/132 |
| 8,354,084 | B2 * | 1/2013 | Tallis | C10G 9/20 422/198 |
| 2004/0000350 | A1 * | 1/2004 | Cymbalisty | B01F 25/433 138/177 |
| 2004/0134557 | A1 * | 7/2004 | Cymbalisty | B01F 25/4331 138/177 |
| 2005/0131263 | A1 * | 6/2005 | Wolpert | F28F 1/40 208/132 |
| 2017/0343300 | A1 | 11/2017 | Clavelle et al. | |

FOREIGN PATENT DOCUMENTS

| | | | |
|---|---|---|---|
| CN | 203758321 | U | 8/2014 |
| EP | 1146105 | A2 | 10/2001 |
| EP | 1561795 | B1 | 4/2014 |

* cited by examiner

[Fig. 1]
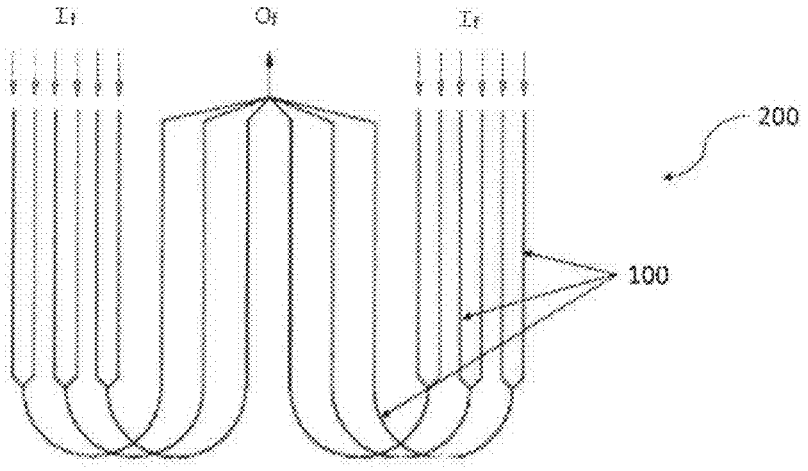
[Fig. 2a]
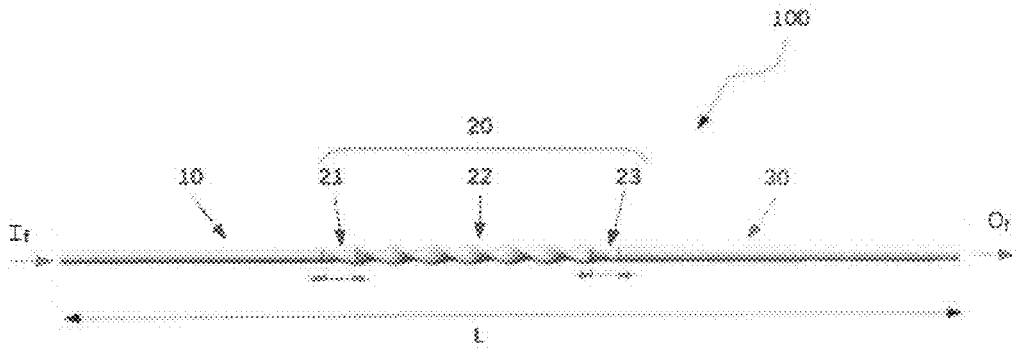

[Fig. 2b]
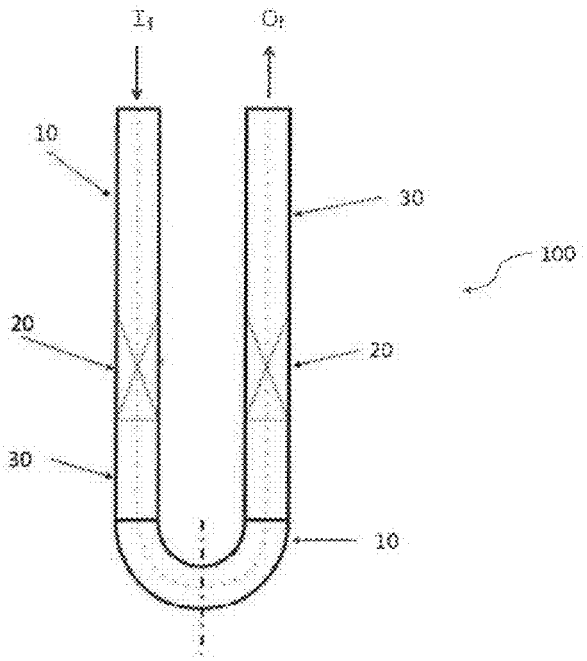
[Fig. 2c]
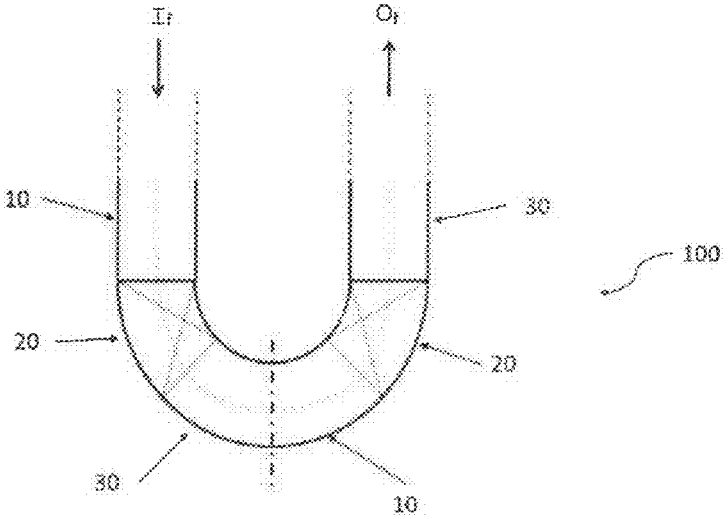

[Fig. 3]
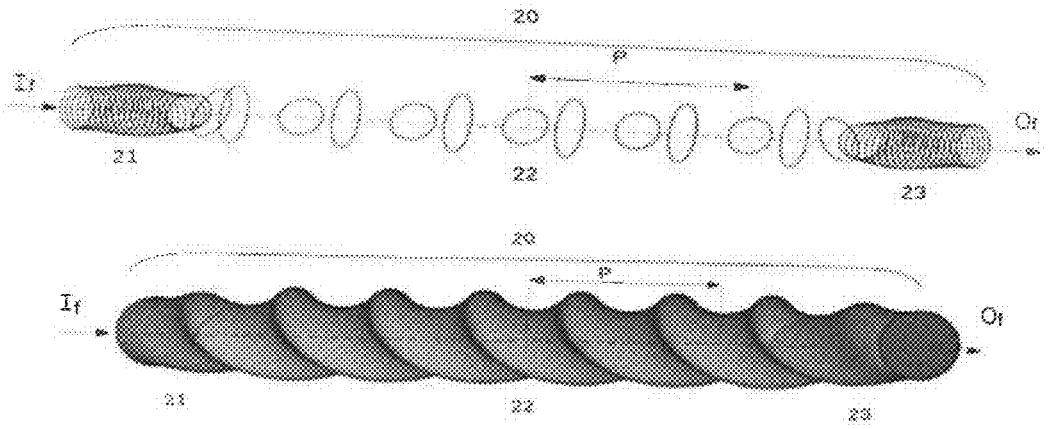
[Fig. 4]
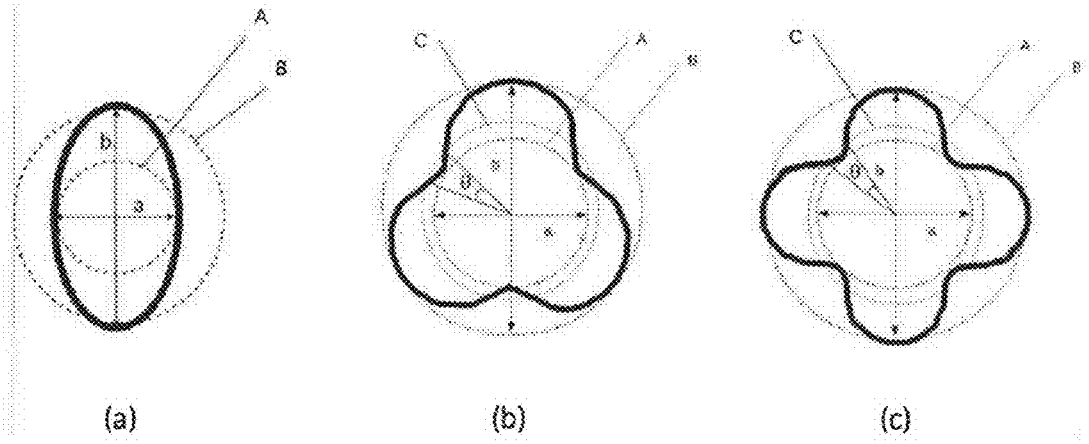
[Fig. 5]
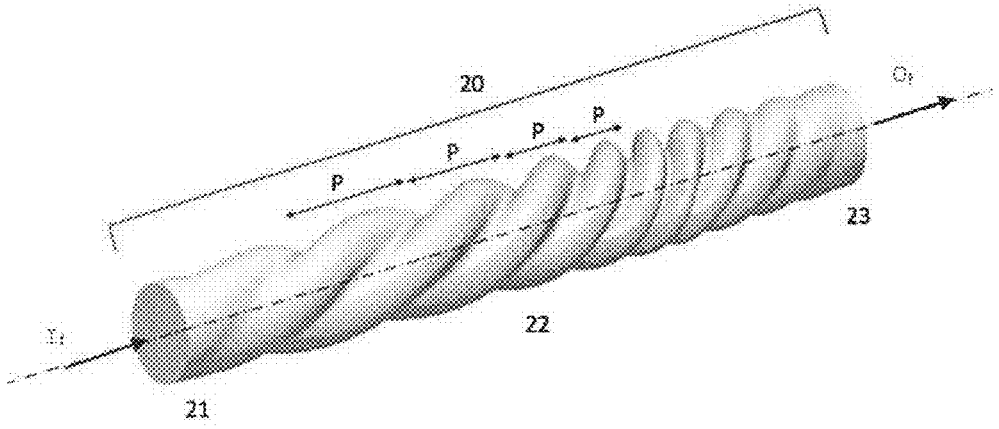

TUBE FOR A STEAM CRACKING FURNACE HAVING A SEGMENT WITH AN ELLIPTICAL OR LOBED CROSS SECTION

CROSS-REFERENCE TO RELATED APPLICATIONS

This application claims the benefit of the filing date of French Patent Application Serial No. 19/05801, filed May 31, 2019.

TECHNICAL FIELD

The present disclosure relates to the field of tubes for steam cracking furnaces. It particularly relates to a tube comprising a twisted segment with an elliptical or lobed section.

BACKGROUND

Improving the heat exchange performance capabilities in steam cracking furnace tubes is a major concern. Steam cracking furnaces are generally made up of an assembly of tubes connected together by elbows, as illustrated in FIG. 1. The design of this assembly of tubes can of course vary according to different criteria, with that of FIG. 1 being shown only by way of an example. The fluid (for example, ethane, naphtha, etc.) and water vapor circulate in this assembly of tubes and are brought to high temperatures in order to trigger a steam cracking reaction. For a given temperature of the inner wall of the tubes, the greater the heat exchanges between the wall and the fluid, the higher the yield of the reaction.

However, spurious reactions are responsible for the deposition of a layer of coke on the inner wall of the assembly of tubes. The thickness of this layer increases over time, which clogs the tubes, decreases the heat transfers between the wall of the assembly of tubes and the flowing fluid and increases the pressure losses.

The kinetics of coke formation partly depend on the temperature of the inner wall of the tubes. It is therefore worthwhile limiting the operating temperature (to limit coking), but at the same time increasing the heat exchange performance capabilities between the tubes and the fluid to obtain a high yield from the steam cracking reaction.

Solutions implementing a swirling flow have thus been proposed since such a flow has the advantage of improving the heat exchanges between the fluid and the inner walls of the assembly of tubes. Indeed, a swirling flow disrupts the dynamic and thermal boundary layer that is conventionally established along smooth cylindrical walls and that negatively affects heat exchange. Furthermore, the increase in parietal stresses linked to a swirling flow can promote the separation of the coke layer. However, it is to be noted that a swirling flow is responsible for an increase in pressure losses compared to a non-swirling flow (a higher fluid inlet pressure is required), which is detrimental to the steam cracking reaction yield. The improvement in heat transfers between the wall of the tube and the fluid, combined with the mixing thereof by the swirling flow, also makes it possible to obtain greater homogenization of the temperatures within a flow section of the tube. In other words, with a swirling flow not only is the average temperature of the fluid closer to that of the wall of the tube, but the standard deviation of the distribution of the temperatures in a flow section is also smaller. The improvement in the homogenization of the temperatures promotes the selectivity of certain chemical species with high added value in the steam cracking reaction and is therefore an important parameter.

Document EP 1561795 proposes an assembly of tubes, the inner wall of which comprises fins discreetly arranged on a helical path. Document US 2005/0131263 proposes a technology involving tubes having internal fins following a helical path. These two approaches provide an efficient level of heat exchanges between the fluid and the assembly of tubes, but at the expense of significant pressure losses, enhanced by the increased number of contact surfaces between the tube and the fluid.

Document U.S. Pat. No. 7,749,462 discloses an assembly of tubes of circular section, the axis of which follows a low amplitude helical path. This solution that promotes heat exchange has the disadvantage of being bigger than a conventional tube and remains complex in terms of manufacturing.

Document U.S. Pat. No. 6,530,422 proposes introducing a twisted blade into the assembly of tubes over a given length of the assembly. This enables the pressure losses to be limited, but the performance capabilities for improving heat exchange remain limited; moreover, this blade generates significant mechanical stresses on the tube due to thermal expansion and leads to operational damage.

BRIEF SUMMARY

The present disclosure provides an alternative solution to the solutions of the prior art. The present disclosure relates to a tube of circular section, comprising at least one twisted tubular segment with an elliptical or lobed section, which segment has a defined aspect ratio and helical pitch. End parts for geometric transition between circular tube segments and the twisted segment are present, so as to promote the heat exchanges while limiting the pressure losses.

The present disclosure relates to a tube for a steam cracking furnace comprising:

- at least one downstream tubular segment of circular section having a main diameter;
- at least one twisted tubular segment having a length less than a quarter of the length of the tube, and comprising:
  - a central part with an elliptical or lobed section, having a helical pitch between one times and ten times the main diameter, and an aspect ratio of the elliptical or lobed section between 0.5 and 0.8;
  - an upstream transition part establishing a geometric transition between the central part and a tubular segment of circular section;
  - a downstream transition part establishing a geometric transition between the central part and the downstream tubular segment.

A fluid is intended to flow in the tube, in the direction proceeding from the upstream transition part toward the downstream transition part.

According to other advantageous and non-limiting features of the present disclosure, taken alone or in any technically feasible combination:

- the helical pitch of the central part of the twisted tubular segment is between five times and ten times the main diameter;
- the helical pitch of the central part of the twisted tubular segment is fixed;
- the helical pitch of the central part of the twisted tubular segment is variable between the upstream transition part and the downstream transition part;

the helical pitch moves linearly and continuously between the upstream transition part and the downstream transition part;

the aspect ratio of the elliptical or lobed section is between 0.6 and 0.7;

the length of the upstream and/or downstream transition parts is between the value of the helical pitch and a quarter of the value of the pitch;

the upstream transition part and/or the downstream transition part establishes a rotational transition, respectively, between the central part and a tubular segment of circular section, and between the central part and the downstream tubular segment;

the upstream transition part and/or the downstream transition part establishes a linear rotational transition, respectively, between the central part and a tubular segment of circular section, and between the central part and the downstream tubular segment;

the length of the twisted tubular segment is between five times the main diameter and twenty times the main diameter;

the tube comprises at least one upstream tubular segment, of circular section having the main diameter, connected to the upstream transition part of the twisted tubular segment;

a twisted tubular segment is present for each section of the tube having a length of the order of one hundred times the main diameter;

the tube has an elbow, at which at least one twisted tubular segment is present;

a twisted tubular segment is disposed at each end of the elbow;

the cross-sectional area of the twisted tubular segment is substantially equal to the circular cross-sectional area of the downstream tubular segment.

BRIEF DESCRIPTION OF THE DRAWINGS

Further features and advantages of the present disclosure will become apparent from the following detailed description of example embodiments of the present disclosure, with reference to the appended figures, in which:

FIG. 1 shows an example of an assembly of tubes for a steam cracking furnace according to the prior art;

FIGS. 2*a*, 2*b* and 2*c* show examples of tubes according to the present disclosure, as a 3D view (FIG. 2*a*) or as schematic views (FIGS. 2*b*, 2*c*);

FIG. 3 shows an illustration of the rotational movement of the section of a twisted tubular segment, included in a tube according to the present disclosure;

FIG. 4 shows different examples of elliptical and lobed sections for a twisted tubular segment, included in a tube according to the present disclosure;

FIG. 5 shows an example of a tube with a three-lobe section, for which the helical pitch of the central part is variable, with upstream and downstream linear rotational transition parts;

Table 1 shows the results of simulations for examples of tubes according to the present disclosure, relating to the improvement of heat transfers and the homogenization of temperatures, and to the increase in pressure losses compared to a reference tube, as well as the intensity of the swirling flow.

DETAILED DESCRIPTION

In the descriptive part, the same reference signs in the figures can be used for the same type of elements. The figures are schematic representations that, for the sake of readability, are not necessarily to scale.

The present disclosure relates to a tube 100 for a steam cracking furnace. Such a tube 100 can have different designs, in particular, including rectilinear sections and curved sections, so as to connect a fluid inlet $I_f$ to a fluid outlet $O_f$. The tube 100 has a total length L, typically between the fluid inlet $I_f$ and the fluid outlet $O_f$. It is to be noted that a plurality of tubes 100 could be used to form an assembly of tubes 200, an example of the design of which is illustrated in FIG. 1. A tube 100 according to the present disclosure is advantageously formed from a steel that is resistant to high temperatures and is between 5 and 15 mm thick.

The tube 100 according to the present disclosure comprises at least one downstream tubular segment 30, of circular section having an internal main diameter D (FIGS. 2*a*, 2*b*).

Advantageously, the tube 100 also comprises at least one upstream tubular segment 10, of circular section having the same main internal diameter D as the downstream tubular segment 30. The terms "upstream" and "downstream" are used herein to describe the direction of flow of the fluid in the tube 100: the fluid is intended to flow from the (at least one) upstream tubular segment 10 toward the (at least one) downstream tubular segment 30. For example, the main internal diameter D can be between 40 and 200 mm.

It is to be noted that, at the fluid inlet $I_f$, the tube 100 may not comprise an upstream tubular segment 10, as shown in FIGS. 2*a* and 2*b*, but may have the twisted tubular segment 20 (closest to the inlet $I_f$) directly connected to a tubular segment of circular section, outside the tube 100, fitted in the steam cracking furnace for the entry of the fluid.

The tube 100 further comprises at least one twisted tubular segment 20, located before the downstream tubular segment 30 of the tube 100 and after the upstream tubular segment 10 when it is present (FIG. 2*a*). A twisted tubular segment is understood to be a segment that shares the same central axis as the upstream 10 and downstream 30 tubular segments of the tube 100, but that has a non-circular section that moves along the segment according to a rotation. In the example of FIG. 3, the twisted tubular segment 20 has an elliptical section.

The twisted tubular segment 20 particularly comprises a central part 22 having an elliptical or lobed section, examples of which are shown in FIG. 4. Irrespective of the elliptical or lobed section, the helical pitch P is defined as the distance that is required for an initial section (at one end of the central part 22) to rotate 360° (FIG. 3). The helical pitch P of the central part 22 therefore converts the torsion that has been introduced into the twisted tubular segment 20, at the central part 22: a high intensity of torsion corresponds to a small helical pitch, a low intensity of torsion corresponds to a high helical pitch. According to the present disclosure, the helical pitch P of the central part 22 of the twisted tubular segment 20 is between one times and ten times the main diameter D of the circular section of the tube 100: $1D \leq P \leq 10D$, It is to be noted that the helical pitch P can be fixed or variable over the extent of the central part 22 of the twisted tubular segment 20. When it is fixed, the helical pitch P is preferably between five times and ten times the main diameter D of the circular section of the tube 100: $5D \leq P \leq 10D$.

Alternatively, the helical pitch P of the central part 22 of the twisted tubular segment 20 can be variable in the upstream to downstream direction. In particular, the helical pitch P can move linearly and continuously, preferably decreasingly, in the direction of an increase in the torsional intensity in the upstream to downstream direction, as illustrated in FIG. 5, for example. Such a moving helical pitch is particularly advantageous in the case of lobed sections, since it improves the heat exchanges and enables significant homogenization of the distribution of temperatures within the flow section for the fluid in the twisted tubular segment 20.

The central part 22 is also characterized by the aspect ratio, denoted AR, of the elliptical or lobed section. The AR aspect ratio is defined as the ratio between:

- the diameter "a" of the circle A inscribed in the elliptical or lobed section and passing through at least two points of the section; in particular, the circle A passes through two points of the elliptical section (FIG. 4 (*a*)), through three points of the three-lobe section (FIG. 4 (*b*)), through four points of the four-lobe section (FIG. 4 (*c*)), and, more generally, through n points of a section with n lobes; and
- the diameter "b" of the circle B, in which the elliptical or lobed section is circumscribed and which passes through at least two points of the section.

The diameter a is called "small diameter a," and the diameter b is called "large diameter b." The aspect ratio AR is therefore the ratio between the small diameter a and the large diameter b: AR=a/b, and is between 0.5 and 0.8, preferably between 0.6 and 0.7.

Advantageously, in the case of a lobed section, the number of lobes is between 3 and 6, since this number of lobes enables a good compromise to be provided between improving heat transfers and increasing pressure losses. Preferably, the number of lobes will be 3 or 4. In addition to the aspect ratio AR, the lobed sections are characterized by an inter-lobe curvature, as shown in FIGS. 4*b* and 4*c*. This curvature has two parameters, the first of which is the angle θ between the two ends of the curvature and varies between 0 and 20°; preferably, the angle θ is 10°. The second parameter is the depth of the curvature and is determined by the intermediate circle C, which passes through the points located at the ends of the curvature; the radius of the intermediate circle C is larger than the radius of the inscribed circle A, by 5 to 10%.

Advantageously, the area of the elliptical or lobed section of the central part 22 of the twisted tubular segment 20 is substantially equal to the area of the circular section of the downstream 30 and upstream 10 tubular segment (if present). Substantially equal is understood to be equal by plus or minus 15%. The conservation of the area of the sections of the tube enables the increase in pressure losses to be limited.

The twisted tubular segment 20 also comprises an upstream transition part 21 and a downstream transition part 23. The upstream transition part 21 establishes a geometric transition between the central part 22 and a tubular segment of circular section (which can be an upstream tubular segment 10 when it is present, or, for example, a tubular connection end for the entry of the fluid, outside the tube 100). The downstream transition part 23 for its part establishes a geometric transition between the central part 22 and the downstream tubular segment 30.

Advantageously, the upstream transition part 21 and/or the downstream transition part 23 establishes a rotational transition between the central part 22 and, respectively, the segments of circular section upstream and downstream of the twisted tubular segment 20.

Rotational transition is understood to mean a geometric transition, connecting the elliptical or lobed section of the central part 22 to the circular section of the upstream or downstream segments, combined with a twist with an intensity that is similar to that of the central part 22 or with intensity that decreases from the central part 22 to the segments of circular section. In other words, the transition parts 21, 23 see the elliptical or lobed section (of the central part 22) gradually move toward a circular section with a main diameter D, whilst being rotated. This movement from the elliptical or lobed section to a circular section may or may not be linear.

The twisted tubular segment 20 of the tube 100 according to the present disclosure enables a swirling flow of the fluid to be established locally in the tube 100, and thus promotes heat exchanges and limits coking. The intensity of rotation of the swirling flow generated at the twisted tubular segment 20 then decreases in the downstream tubular segment 30. In an assembly of very long tubes 200, several twisted tubular segments 20 can be arranged along the assembly so as to maintain a swirling flow, with a high and then decreasing intensity, over its entire length, as illustrated in FIG. 2*b*, for example.

The local generation of a swirling flow with a high and then decreasing intensity also has the advantage of significantly limiting the pressure losses.

In addition, when an upstream transition part 21 is implemented, this enables the rotation of the fluid to be established gradually, causing the fluid to transition from a mainly axial flow upstream to a swirling flow in the central part 22 of the twisted tubular segment 20.

When a downstream transition part 23 is implemented, it enables the rotation of the fluid to be accompanied and the swirling flow to last longer in the downstream tubular segment 30.

These particular transitions avoid sudden changes in sections of the tube 100 and effectively help to reduce the pressure losses.

Preferably, the twisted tubular segment 20 is of limited length relative to the total length of the tube 100. Typically, it can be between five times and twenty times as long as the main diameter D. The length of the twisted tubular segment 20 is generally less than a quarter of the length of the tube 100. Advantageously, its length is less than a quarter of the sum of the lengths of the upstream tubular segment 10 and of the downstream tubular segment 30.

For example, a twisted tubular segment 20 can be inserted for each section of tube 100 that is of the order of one hundred times as long as the main diameter D, and can represent approximately one fifth of the length.

According to another example, for a tube 100 or an assembly of tubes 200 having a total length of five hundred times the main diameter D, the insertion of five twisted tubular segments 20, distributed over the total length, will be recommended.

As the twisted tubular segment 20 has a limited length relative to the total length of the tube 100 or of the assembly of tubes 200, it may be advantageous for it to be manufactured and then assembled by welding to the different tubular segments of circular section forming the tube 100. Alternatively, a straight tube could be locally deformed to obtain a rotary elliptical or lobed section forming the twisted tubular segment 20, between upstream tubular segments 10 (if present) and downstream tubular segments 30 of circular section.

Advantageously, the length $L_{tr}$ of the upstream 21 and downstream 23 transition parts is between the value of the helical pitch P and a quarter of the value of the pitch P. Preferably, the length of the upstream 21 and downstream 23 transition parts is defined at the value of half a helical pitch P. In the case of a variable helical pitch, the length $L_{tr}$ is advantageously between the maximum value of the helical pitch and a quarter of the maximum value.

According to a first embodiment, the tube 100 comprises a plurality of rectilinear sections connected by one or more elbow(s) (two sections connected by an elbow in the example illustrated in FIG. 2*b*): a twisted tubular segment 20 is inserted into at least one of the rectilinear sections, more advantageously into each of the sections.

According to a second embodiment, the tube 100 also comprises a plurality of rectilinear sections connected by at least one elbow and at least one twisted tubular segment 20 is inserted at the elbow. In the example of FIG. 2*c*, a twisted tubular segment 20 is arranged at each end of the elbow. A first downstream tubular segment 30 (on the left relative to the axis of symmetry of the elbow) and a second upstream tubular segment 10 (on the right relative to the axis of symmetry of the elbow) form an elbow portion. Two twisted tubular segments 20, one arranged between the first upstream tubular segment 10 and the first downstream tubular segment 30 (to the left relative to the axis of symmetry of the elbow) and the other arranged between the second upstream tubular segment 10 and the second downstream tubular segment 30 (to the right relative to the axis of symmetry of the elbow), form a matching elbow portion.

Alternatively, a single twisted tubular segment 20, centered on the axis of symmetry of the elbow, and extending over all or part of the elbow could be implemented.

This embodiment is advantageous in that it at least allows the contributions of the elbow and of the twisted tubular segment 20 to the pressure losses to be shared. It is also liable to reduce the pressure losses caused by the elbow itself.

The first and second embodiments can of course be combined, by inserting twisted tubular segments 20 into the rectilinear sections and/or the elbows of a tube 100 or of an assembly of tubes 200.

Examples of Simulation Results:

The digital flow simulations were obtained from the Open-source OpenFOAM software. The digital geometries of the tubes 100 were obtained from the open-source FreeCAD CAD (Computer Assisted Design) software.

The thermodynamic properties of the fluid are those of air under normal temperature and pressure conditions. The flow parameters, as well as the adopted boundary conditions, are the same as those described in the publications by Tang et al. ("Experimental and numerical investigation of convective heat transfer and fluid flow in twisted spiral tube," International Journal of Heat and Mass Transfer, 90 (2015), 523-541). The turbulence modeling for its part is a little different since a Low-Reynolds approach with a turbulence model k-ω SST (Shear Stress Transport) was favored for solving the different equations of the flow and those of the boundary layer. It is to be noted that the study of the swirling flow is not limited to the inner zone of the twisted tubular segment 20, but also extends to the downstream tubular segment 30 of circular section in order to take into account the decrease in rotation intensity of the flow.

Different tubes 100, comprising a twisted tubular segment 20 between upstream 10 and downstream 30 segments of circular section, were evaluated relative to a reference tube ("Ref" in Table 1) of completely circular section: the evaluation relates to the improvement of heat transfers, the improvement of the homogenization of temperatures and the increase in pressure losses compared to the reference tube, as well as the intensity of rotation of the swirling flow. It is to be noted that the following results are provided for a Reynolds number of 10,000.

Table 1 shows the different tubes tested with a total length 100D (with D being the inner diameter of the circular section of the upstream 10 and downstream 30 segments, called the main diameter) and the expected performance capabilities for each of them.

TABLE 1

| # | Features of the tube (Total length 100D) | | Improvement of heat transfers/Ref. | Increase of pressure losses/Ref. | Intensity of the swirling flow | Improvement of the homogenization of the temperatures/Ref. |
|---|---|---|---|---|---|---|
| Ref. | | Completely circular section | — | — | 0% | — |
| 1 | Twisted segment of length 20D with | AR = 0.6<br>P = 10D | 13% | 33% | 8% | 4.10% |
| 2 | central part with an elliptical section; | AR = 0.6<br>P = 5D | 22% | 63% | 14% | 12.10% |
| 3 | geometric upstream and downstream transition parts | AR = 0.7<br>P = 5D | 17% | 44% | 9% | 6.60% |
| 4 | Twisted segment of length 20D with central part with an | AR = 0.6<br>P = 5D<br>L\$_{tr}$\ = P | 26% | 40.3% | 11% | 9.60% |
| 5 | elliptical section and with upstream and downstream linear | AR = 0.6<br>P = 5D<br>L\$_{tr}$\ = P/2 | 33% | 46.5% | 12% | 7.00% |
| 6 | rotational transition parts | AR = 0.6<br>P = 5D<br>L\$_{tr}$\ = P/4 | 31% | 49.5% | 12% | 5.80% |
| 7 | Twisted segment of length 20D with central part with three lobes and upstream and downstream linear rotational transition parts | AR = 0.6<br>P = 5D<br>L\$_{tr}$\ = P/2 | 30% | 123% | 22% | 11.40% |
| 8 | Twisted segment of length 10D with central part with a | AR = 0.6<br>P = 5D<br>L\$_{tr}$\ = P/2 | 25% | 41% | 22% | 3.50% |

TABLE 1-continued

| # | Features of the tube (Total length 100D) | | Improvement of heat transfers/Ref. | Increase of pressure losses/Ref. | Intensity of the swirling flow | Improvement of the homogenization of the temperatures/Ref. |
|---|---|---|---|---|---|---|
| 9 | three-lobe section and upstream and downstream linear rotational transition parts | AR = 0.5<br>P = 5D<br>L\$_{tr}$\ = P/2 | 28% | 49% | 32% | 7.80% |
| 10 | | AR = 0.6<br>P = 2D<br>L\$_{tr}$\ = P/2 | 35% | 79% | 22% | 10.60% |
| 11 | Twisted segment with a variable helical pitch of length 10D with a central part with a three-lobe section and upstream and downstream linear rotational transition parts | AR = 0.6<br>P = 5D --> 1D<br>L\$_{tr}$\ = 5D/2 | 33% | 59% | 22% | 7.80% |

It should be noted that the aim is to improve both heat transfers and homogenization of the temperatures, to best limit the increase in pressure losses compared to the reference tube, and to obtain a rotation intensity of the swirling flow that is as large as possible and, in particular, is as close as possible to 10% or even greater.

The tubes referenced #1, #2 and #3 according to the present disclosure comprise a twisted tubular segment 20 of length 20D, with a central part 22 of elliptical section and upstream 21 and downstream 23 transition parts establishing a geometric transition, respectively, with the upstream 10 and downstream 30 tubular segments. The helical pitches and the aspect ratios of tubes #1, #2 and #3 are shown in Table 1.

These three examples of tubes enable the heat transfers to be improved by between 13% and 22% and the homogenization of the temperatures in the flow sections of the tube from 4.1% to 12.1% compared to a conventional tube with a completely circular section. A smaller helical pitch P (for the same aspect ratio AR) promotes the increase in heat transfers, the homogenization of the temperatures and the intensity of the swirling flow (tube #2 versus tube #1); at the same time, this also significantly increases the pressure losses. By increasing the aspect ratio AR, it is possible to limit the increase in pressure losses, whilst maintaining a correct level of improvement of heat transfers and of homogenization of temperatures, and an intensity of the swirling flow close to 10% (tube #3 versus tube #2).

Tubes #4, #5, #6, according to preferred embodiments of the present disclosure, comprise a twisted tubular segment 20 of length 20D, with a central part 22 of elliptical section and upstream and downstream transition parts 21 and 23 establishing a linear rotational transition, respectively, with the upstream 10 and downstream 30 tubular segments. The helical pitches, the aspect ratios and the lengths of the transition parts (identical upstream 21 and downstream 23) of tubes #4, #5 and #6 are indicated in Table 1.

The use of upstream 21 and downstream 23 rotational transition parts has a very beneficial effect both on the heat transfers, which exhibit a greater increase, and on the pressure losses, the increase of which is more limited than in the case of a transition that is only geometric (tubes #4, 5, 6 vs tube #2). The intensity of the swirling flow between 11% and 12% is also improved.

The twisted tubular segment 20 provided with upstream 21 and downstream 23 transition parts is therefore particularly favorable for obtaining good energy performance capabilities.

Tube #7, according to the present disclosure, comprises a twisted tubular segment 20 of length 20D, with a central part 22 with a three-lobed section and upstream 21 and downstream 23 transition parts establishing a linear rotational transition, respectively, with the upstream 10 and downstream 30 tubular segments. The helical pitch, the aspect ratio and the lengths of the transition parts (identical upstream 21 and downstream 23) of tube #7 are indicated in Table 1.

The adoption of a flow section with three lobes allows a marked increase in the intensity of the swirling flow and is accompanied by greater homogenization of the temperatures in the tube (tube #5 vs tube #7). However, these improvements are made at the expense of a significant increase in pressure losses.

Tubes #8, #9, #10, according to preferred embodiments of the present disclosure, comprise a twisted tubular segment 20 of length 10D, with a central part 22 with a three-lobed section and upstream 21 and downstream 23 transition parts establishing a linear rotational transition, respectively, with the upstream 10 and downstream 30 tubular segments. The helical pitches, the aspect ratios and the lengths of the transition parts (identical upstream 21 and downstream 23) of tubes #8, #9 and #10 are indicated in Table 1.

The reduction in the length of the twisted segment, the section of which has three lobes, enables a significant reduction in the pressure losses from a 123% to a 41% increase (tube #7 vs tube #8), and this occurs without significantly affecting the improvement of the heat transfers. Furthermore, the reduction in the length of the device also enables material to be saved.

The reduction in the aspect ratio allows a marked increase in the intensity of the swirling flow, which generates a significant improvement in the homogenization of temperatures for an increase in pressure losses that remains moderate (tube #8 vs tube #9).

The increase in the twist of the helical pitch from P=5D to P=2D (tube #8 vs tube #10) enables both greater improvement in heat transfers and better homogenization of the temperatures to be obtained. However, this is achieved at the expense of a relatively large increase in pressure losses.

Tube #11, according to a preferred embodiment of the present disclosure, comprises a twisted tubular segment 20 of length 10D, with a central part 22 with a three-lobed section and with a helical pitch that varies linearly and continuously from 5D to 1D. This tube also has upstream 21 and downstream 23 transition parts establishing a linear rotational transition, respectively, with the upstream 10 and downstream 30 tubular segments. The aspect ratio and the length of the transition parts (identical upstream 21 and downstream 23) of tube #11 are indicated in Table 1.

The adoption of the variable helical pitch enables the improvement of heat transfers, as well as the homogenization of the temperatures (tube #11 vs tube #8), to be significantly increased without experiencing the same counter cost on the pressure losses than with a tight and constant helical pitch (tube #11 vs tube #10).

Of course, the invention is not limited to the embodiments and examples that have been described, and it is possible to add alternative embodiments thereto without departing from the scope of the invention as defined by the claims.

The invention claimed is:

1. A tube for a steam cracking furnace comprising:

at least one downstream tubular segment of circular section having a main diameter;

at least one twisted tubular segment having a length less than a quarter of the length of the tube, and comprising:

a central part with an elliptical or lobed section, having a helical pitch between one times and ten times the main diameter, and an aspect ratio of the elliptical or lobed section between 0.5 and 0.8;

an upstream transition part establishing a geometric transition between the central part and a tubular segment of circular section; and a downstream transition part establishing a geometric transition between the central part and the downstream tubular segment, with a fluid being intended to flow from the upstream transition part to the downstream transition part.

2. The tube of claim 1, wherein the helical pitch of the central part of the twisted tubular segment is fixed, and is between five times and ten times the main diameter.

3. The tube of claim 1, wherein the helical pitch of the central part of the twisted tubular segment is variable between the upstream transition part and the downstream transition part.

4. The tube of claim 3, wherein the helical pitch moves linearly and continuously between the upstream transition part and the downstream transition part.

5. The tube of claim 4, wherein the aspect ratio of the elliptical or lobed section is between 0.6 and 0.7.

6. The tube of claim 5, wherein the length of the upstream and/or downstream transition parts is between the value of the helical pitch and a quarter of the value of the pitch.

7. The tube of claim 6, wherein the upstream transition part and/or the downstream transition part establishes a rotational transition, respectively, between the central part and a tubular segment of circular section, and between the central part and the downstream tubular segment.

8. The tube of claim 7, wherein the upstream transition part and/or the downstream transition part establishes a linear rotational transition, respectively, between the central part and a tubular segment of circular section, and between the central part and the downstream tubular segment.

9. The tube of claim 8, wherein the length of the twisted tubular segment is between five times the main diameter and twenty times the main diameter.

10. The tube of claim 9, further comprising at least one upstream tubular segment, of circular section having the main diameter, connected to the upstream transition part of the twisted tubular segment.

11. The tube of claim 1, wherein a twisted tubular segment is present for each section of the tube having a length of at least about one hundred times the main diameter.

12. The tube of claim 1, further comprising having an elbow, at which at least one twisted tubular segment is present.

13. The tube of claim 12, wherein a twisted tubular segment is disposed at each end of the elbow.

14. The tube of claim 1, wherein the area of the section of the twisted tubular segment is substantially equal to the area of the circular section of the downstream tubular segment.

15. The tube of claim 1, wherein the aspect ratio of the elliptical or lobed section is between 0.6 and 0.7.

16. The tube of claim 1, wherein the length of the upstream and/or downstream transition parts is between the value of the helical pitch and a quarter of the value of the pitch.

17. The tube of claim 1, wherein the upstream transition part and/or the downstream transition part establishes a rotational transition, respectively, between the central part and a tubular segment of circular section, and between the central part and the downstream tubular segment.

18. The tube of claim 1, wherein the upstream transition part and/or the downstream transition part establishes a linear rotational transition, respectively, between the central part and a tubular segment of circular section, and between the central part and the downstream tubular segment.

19. The tube of claim 1, wherein the length of the twisted tubular segment is between five times the main diameter and twenty times the main diameter.

20. The tube of claim 1, further comprising at least one upstream tubular segment, of circular section having the main diameter, connected to the upstream transition part of the twisted tubular segment.

* * * * *